US006678486B2

(12) United States Patent
Amering et al.

(10) Patent No.: US 6,678,486 B2
(45) Date of Patent: Jan. 13, 2004

(54) INTEGRATED CONTAMINATION CONTROL SYSTEM FOR A CORONA CHARGER

(75) Inventors: Allan R. Amering, Rochester, NY (US); Kenneth J. Brown, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 10/080,004

(22) Filed: Feb. 21, 2002

(65) Prior Publication Data

US 2003/0044195 A1 Mar. 6, 2003

Related U.S. Application Data

(60) Provisional application No. 60/317,397, filed on Sep. 5, 2001.

(51) Int. Cl.[7] ..... G03G 15/02

(52) U.S. Cl. ..... 399/92; 399/100

(58) Field of Search ..... 399/92, 93, 98, 399/100, 170–172; 250/324–326

(56) References Cited

U.S. PATENT DOCUMENTS 4,720,727 A * 1/1988 Yoshida ..... 399/93
5,457,521 A * 10/1995 Makiura et al. ..... 399/93
6,072,966 A * 6/2000 Matsuo ..... 250/324
6,397,024 B1 * 5/2002 Rejewski et al. ..... 399/92

* cited by examiner

*Primary Examiner*—William J. Royer

(57) ABSTRACT

A method and structure for an image processing apparatus includes a photoconductive surface adapted to receive an electrostatic charge from a charging device, and a contamination control apparatus adjacent the photoconductive surface. The contamination control apparatus has an input air port and an output air port that produce an air current that removes contaminates from an area near the charging device.

6 Claims, 4 Drawing Sheets

INTEGRATED CONTAMINATION CONTROL SYSTEM FOR A CORONA CHARGER

CROSS REFERENCE TO RELATED APPLICATION

Reference is made to and priority claimed from U.S. Provisional Application Ser. No. 60/317,397, filed Sep. 5, 2001, entitled INTEGRATED CONTAIMINATION CONTROL SYSTEM FOR A CORONA CHARGER CONTROL.

BACKGROUND OF THE INVENTION

1. Field of the Invention

The present invention relates in general to an image processing apparatus and more particularly to an apparatus that removes undesirable effluents from the interior of a corona charging device.

2. Description of the Related Art

In a typical commercial reproduction apparatus (electrostatographic copier/duplicators, printers, electrophotographic devices, or the like), a latent image charge pattern is formed on a uniformly charged dielectric member. Pigmented marking particles are attracted to the latent image charge pattern to develop images on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There, the image is fixed to the receiver member by heat and/or pressure from the fuser apparatus to form a permanent reproduction thereon. Corona charging is a common technology used to charge surfaces in electrophotographic (EP) engines. Corona devices work by ionizing air by applying a high potential on a small diameter wire or equivalent. These corona devices can also produce undesirable effluents as a result of the ionization process. These effluents can include $O_2$ (Ozone) and $NO_x$. Ozone can be an irritant and can attack rubber and other materials, and $NO_x$ can interact with moisture in the air to form dilute Nitric Acid which, if deposited on the surface of a photoconductor (PC), can result in image defects (Charger Rest Defect-CRD) due to lateral conductivity on the PC surface. Certain deposits can precipitate on the surface of corona wires causing non-uniform corona emission and, hence, non-uniform charging of the PC surface. The corona charger also needs to be protected from contamination that is sometimes introduced into the corona charger from other subsystems that are in the electrophotographic device; most notably, toner dust and paper fibers and filler.

Therefore, there is a need for these effluents/contamination to be eliminated/removed from the corona charger or charging device during operation. With the invention described below, effluents are directed to a secondary device(s) where the effluents can be removed from the apparatus and be catalyzed (neutralized) to improve the operation of the apparatus.

SUMMARY OF THE INVENTION

In view of the foregoing and other problems, disadvantages, and drawbacks of the conventional image processing apparatus, the present invention has been devised, and it is an object of the present invention, to provide a structure and method for an improved image processing apparatus. This invention provides an integrated charger ventilation system used to improve the reliability of the charging function. An air curtain across the mouth of a charger prevents ingestion of outside contaminants. A high flow, low velocity vacuum duct is used to exhaust corona effluents and other contaminants from the interior of the charger. A duct on the upstream side of the charger, facing the photoconductor surface of a photoconductor drum, scavenges contaminants that could enter the charger in the boundary layer created by the rotation of the photoconductor drum.

In order to attain the objects suggested above, there is provided, according to one aspect of the invention, an image processing apparatus having a photoconductive surface that receives an electrostatic charge from a charging device and a contamination control apparatus adjacent the photoconductive surface. The contamination control apparatus has an input air port and an output air port that produce an air current that removes contaminates from an area near the charging device. The air current prevents air exterior to the contamination control apparatus from entering the contamination control apparatus. The contamination control apparatus includes a pull duct that draws the contaminates from the area near the photoconductive surface. The pull duct includes an output air port for receiving contaminate particles redirected by the air current and a second opening for drawing contaminate particles from the photoconductor drum. The contamination control apparatus includes an intake duct near the photoconductive surface that removes contaminants. The air current deflects contaminants not removed by the intake duct to prevent the contaminants from entering the contamination control apparatus. During a charging of the photoconductive surface, ambient contaminants that are produced near the charging device are prevented from contaminating the photoconductive surface by the air current.

In a method embodiment, the invention processes images by charging a photoconductive surface using a charging device, providing an air current adjacent to the charging device, modifying the charge on the photoconductive surface relative to an image being processed, and transferring image marking particles to an image recording medium using the charge on the photoconductive surface. The air current removes contaminants from an area near the charging device. The air current further prevents contaminants from entering the charging device and removes contaminants from the charging device. The air current is created by an input air port and an output air port within the charging device. The input air port and the output air port form portions of sidewalls of the charging device and further draw contaminants from the photoconductive surface.

The invention provides two basic modes of contamination control. First, the invention prevents effluents created by the corona process from migrating into the rest of the EP engine and, secondly, the invention protects the charging device or corona charger from being contaminated with effluents (primarily toner dust) emitted from other subsystems in the EP engine. By using a non-contact high-velocity, low-flow airflow air curtain, the inventive contamination control system does not impede the function of the corona charger.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF PREFERRED EMBODIMENTS OF THE INVENTION

Figure 1A:
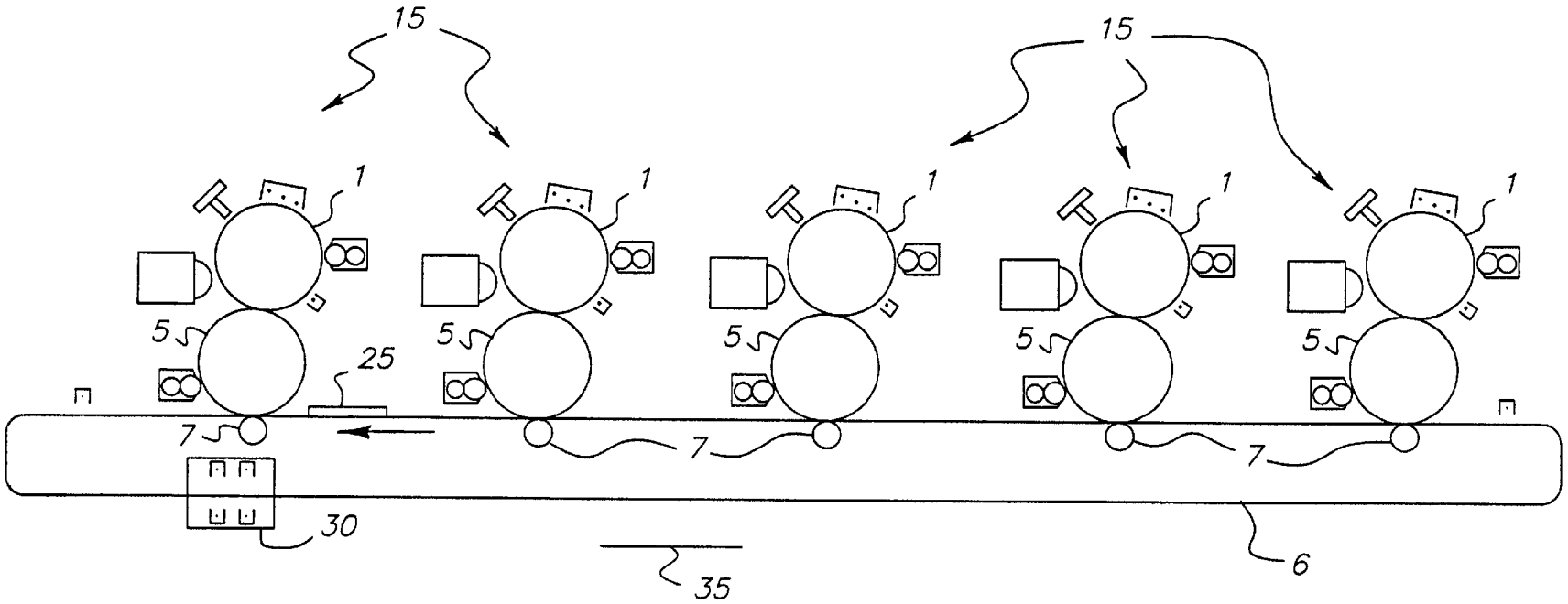
FIGS. 1A and 1B are side elevation schematic drawings of a color printer apparatus utilizing a cleaning apparatus of the invention.
Figure 1B:
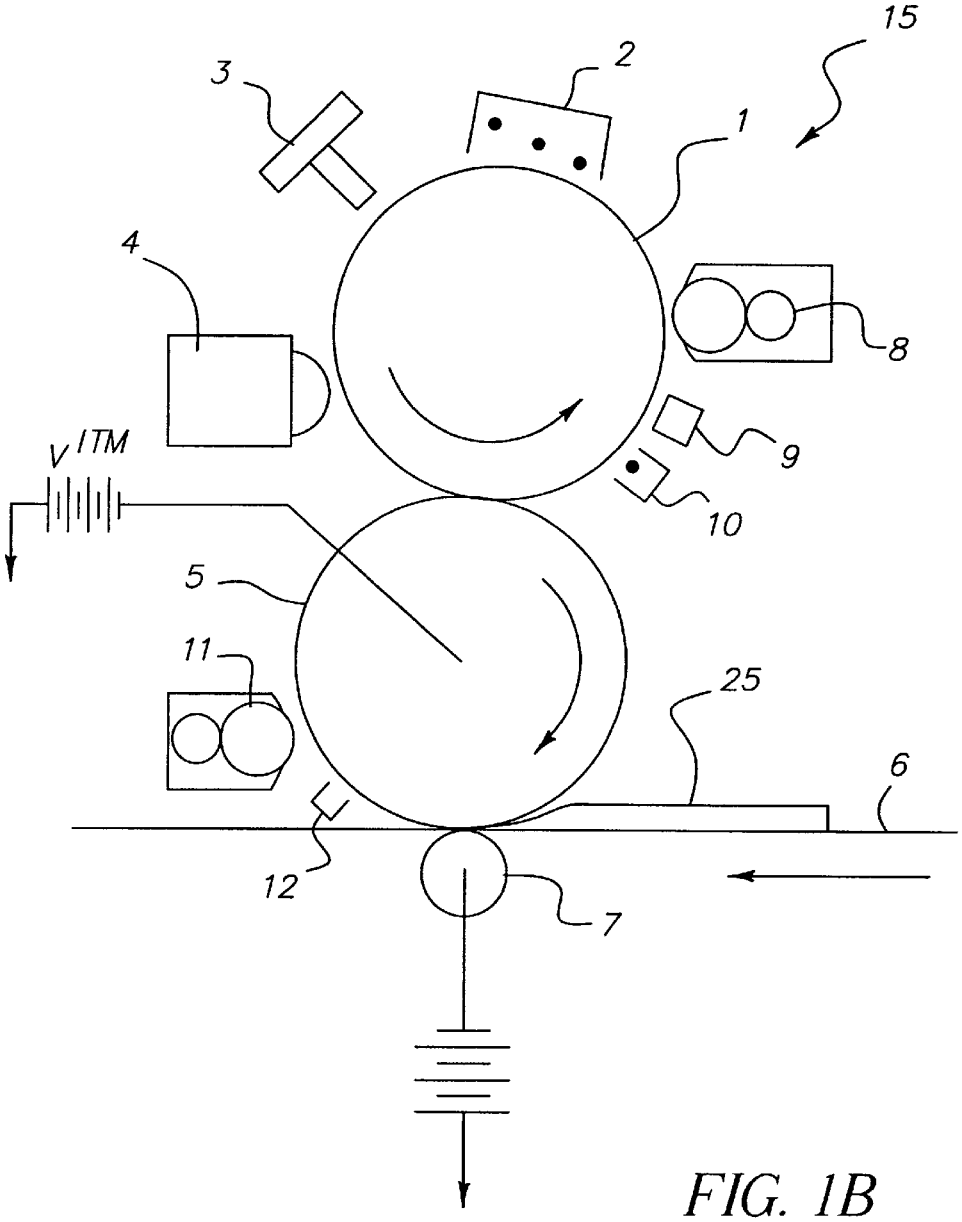

FIG. 1A illustrates an apparatus in which the invention may be used. A conveyor 6 is drivable to move a receiving sheet 25 (e.g., paper, plastic, or the like) past a series of imaging stations 15. One of the imaging stations 15 is shown in greater detail in FIG. 1B.

With the invention, a primary image member 1 (for example, a photoconductive drum) within each imaging station 15 is initially charged by a primary charging station 2. This charge is then modified by a printhead 3 (e.g., LED printhead) to create an electrostatic image on the primary image member 1. A development station 4 deposits toner on the primary image member 1 to form a toner image corresponding to the color toner in each individual imaging station 15. The toner image is electrostatically transferred from the primary image member 1 to an intermediate member, for example, intermediate transfer roller or drum 5. While both the primary image transfer member 1 and the intermediate transfer drum 5 are shown as drums, as would be known by one ordinarily skilled in the art, these could also comprise belts or similar image transfer surfaces. The primary image member 1 and the intermediate transfer drum 5 are used in these examples to simplify the explanation of the invention; however, the invention is not limited to drums, but instead, is applicable to all similar structures/surfaces.

Figure 2:
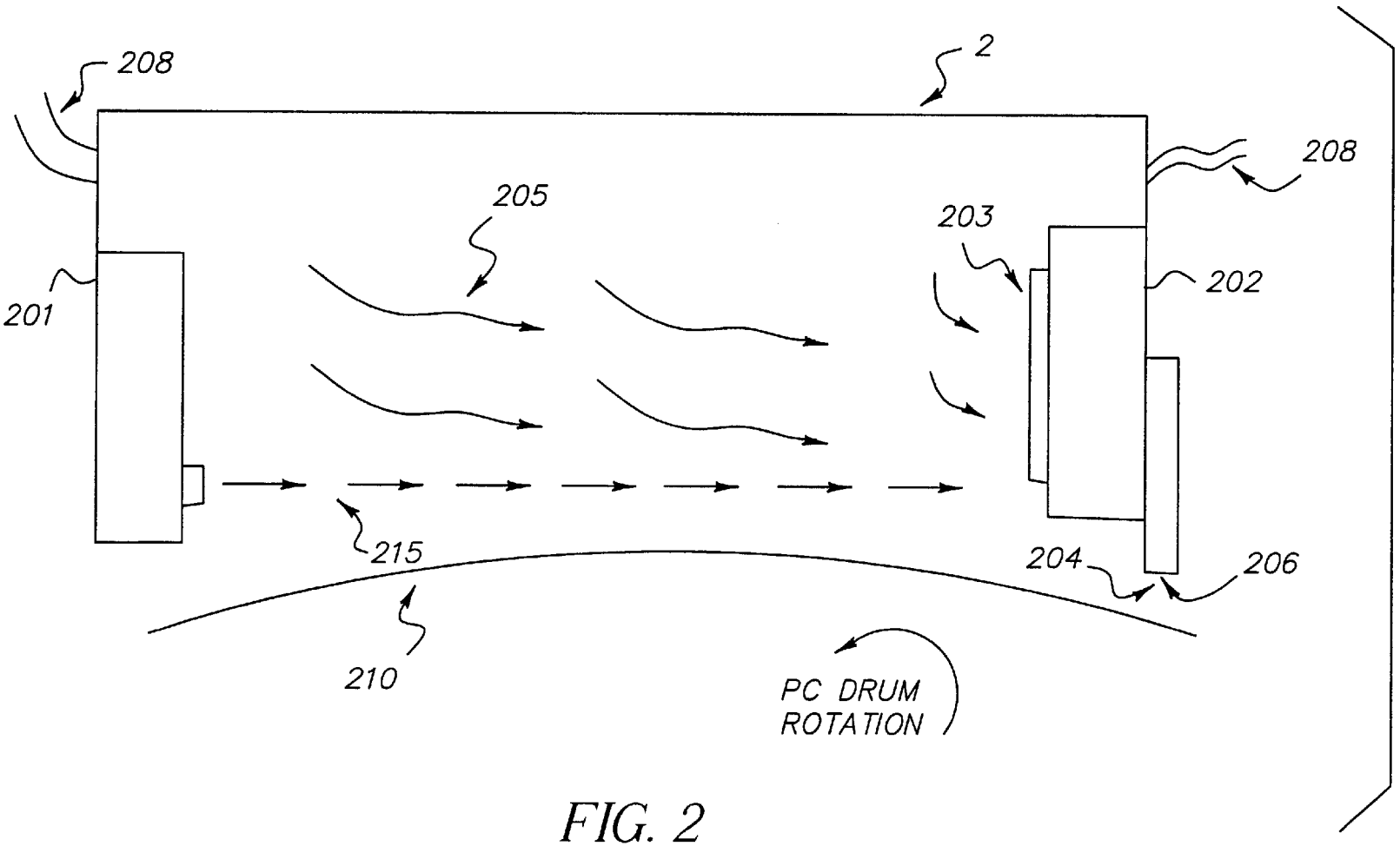
FIG. 2 is a side elevation schematic showing in greater detail the cleaning apparatus forming a part of the apparatus of FIG. 1.

After the charged toner is transferred to the intermediate transfer drum 5, there still remains some waste toner particles that need to be removed from the primary image member 1. The invention uses a pre-cleaning erase light emitting diode (LED) lamp 9 in combination with pre-cleaning charging station 10 in order to electrostatically modify the surface potential of the non-image areas of the primary image member 1 and the charge on the waste toner remaining on the primary image member 1, respectively. In addition, a cleaning station 8 is included to physically remove any remaining waste toner particles. The cleaning station 8 is illustrated in FIG. 2 and is discussed in greater detail below.

A transfer nip is used between a transfer backer roller 7 and the intermediate transfer drum 5 to transfer the toner image to the a receiving sheet 25. In a similar manner to that discussed above, the remaining waste toner particles that remain on the intermediate transfer drum 5 after the toner has been transferred to the receiving sheet 25 are removed using a pre-cleaning charging station 12 and a cleaning station 11. Once again, the details of the cleaning station 11 are shown in FIG. 2 and are discussed below in detail. The receiving sheet 25 is transported by a dielectric conveyor 6 to a fuser 30 where the toner image is fixed by conventional means. The receiving sheet is then conveyed from the fuser 30 to an output tray 35.

The toner image is transferred from the primary image member 1 to the intermediate transfer drum 5 in response to an electric field applied between the core of intermediate transfer drum 5 and a conductive electrode forming a part of primary image member 1. The toner image is transferred to the receiving sheet 25 at the nip in response to an electric field created between the transfer backer roller 7 and the intermediate transfer drum 5. Thus, intermediate transfer drum 5 helps to establish both electric fields. As is known in the art, a polyurethane roller containing an appropriate amount of anti-static material to make it of at least intermediate electrical conductivity can be used for establishing both fields. Typically, the polyurethane or other elastomer is a relatively thick layer; e.g., one-quarter inch thick, which has been formed on an aluminum base.

Preferably, the electrode buried in the primary image member 1 is grounded for convenience in cooperating with the other stations in forming the electrostatic and toner images. If the toner is a positively-charged toner, an electrical bias $V_{ITM}$ is applied to the intermediate transfer drum 5 of typically −300 to −1,500 volts and will effect substantial transfer of toner images to the intermediate transfer drum 5. To then transfer the toner image onto a receiving sheet 25, a bias, e.g., of −2,000 volts or greater negative voltages, is applied to transfer backer roller 7 to again urge the positively-charged toner to transfer to the receiving sheet 25. Schemes are also known in the art for changing the bias on intermediate transfer drum 5 between the two transfer locations so that transfer backer roller 7 need not be at such a high potential.

The ITM or intermediate transfer drum 5 has a polyurethane base layer upon which a thin skin is coated or otherwise formed having the desired release characteristics. The polyurethane base layer is preferably supported upon an aluminum core. The thin skin may be a thermoplastic and should be relatively hard, preferably having a Young's modulus in excess of $5 * 10^7$ Newtons per square meter to facilitate release of the toner to ordinary paper or another type of receiving sheet 25. The base layer is preferably compliant and has a Young's modulus of $10^7$ Newtons per square meter or less to assure good compliance for each transfer.

The contamination control apparatus shown in FIG. 2 is integrated with a corona charger, in this case the primary charging station 2, shown in FIG. 1A. While the primary charging stations 2, is shown as being located at a specific position, the location around the apparatus can vary, depending on the specific architecture.

More specifically, FIG. 2 illustrates the outer surface 210 of the primary image member 1. The primary charging station or corona charger 2 includes a push duct 201 and a pull duct 202, as well as power supply wiring 208, to create the charge condition. The push duct 201 creates a positive air curtain 215 that flows from the push duct 201 to the pull duct 202. The push duct 201 creates a high velocity air stream such that effluents 205 cannot breach in the air curtain 215 and, instead, flow to an opening 203 in the pull duct 202. The corona charger 2 is held in close proximity to the drum surface 210 by well-known mechanical support structures (e.g., brackets). Such support structures are not illustrated in the drawings so as not to obscure the salient features of the invention.

Therefore, the push duct 201 and the pull duct 202 are positioned along the inner sidewalls of the corona charger 2. In a preferred embodiment, the push duct 201 and the pull duct 202 are integral with the corona charger 2 and actually comprise a portion of the sidewalls of the corona charger 2. However, as would be known by one ordinarily skilled in the art, the push duct 201 and the pull duct 202 could also be attached to the ends of the sidewalls as extensions of the corona charger 2.

The corona charger 2 is formed as a box with an open side pointing toward the drum surface 210. The positive air curtain or air current 215 that flows between the push duct or input air port 201 and the pull duct or output air port 202 forms a virtual side that closes the "box" of the corona charger 2. Therefore, the air current 215 acts as a side of the box to contain the effluents 205, yet allows charge to be transferred from the corona charger 2 to the drum surface 210 of the primary image member 1.

In a preferred embodiment, the ducts 201, 202 are located approximately 3.65 mm above the drum surface 210. The push duct 201 has an opening having a duct width of approximately 1.3 mm. The opening in the pull duct 203 has a duct width of approximately 5 mm. An opening slot 204 that removes waste particles in an air flow stream 206 has a duct width size of approximately 3 mm. These measurements are given for illustrative purposes only and the invention is not restricted to these sizes. To the contrary, as would be known by one ordinarily skilled in the art, the size of the openings (as well as the velocity and volume of air in the positive air curtain 215) could be varied to accommodate the specific needs of a given image processing apparatus.

The push duct 201 is a high-velocity, low-flow airflow device, while the pull duct 202 is a low-velocity, higher-flow duct used to exhaust the corona charger cavity of the corona effluents. Preferably, the following ranges of airflow reduce effluents substantially: push airflows of 1–5 cfm and pull airflows of 14–30 cfm. In addition, the pull duct 202 includes the opening slot or secondary opening 204 which draws in, in the air flow stream 206, external contamination such as waste toner, paper fibers, and the like. The pull duct 202 preferably draws air through a filter that collects the waste particles and that can be easily replaced. Therefore, the invention properly ventilates the corona charger 2 to prevent unwelcomed side effects from the corona effluents (Ozone and Nitrous Oxide), and to protect the corona charger 2 from the infiltration of contaminants that can cause degradation in the uniformity of corona emission.

Figure 3A:
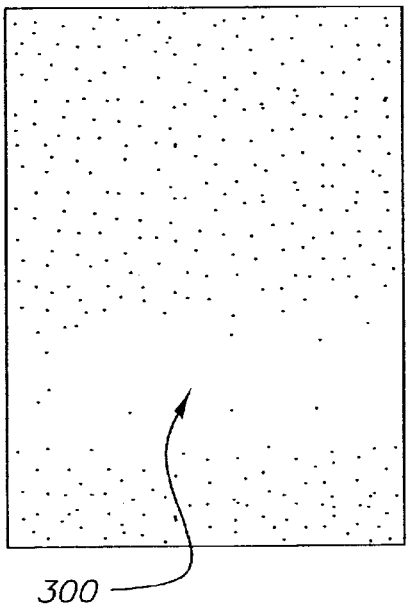
FIGS. 3A and 3B are schematic drawings illustrating a problem that occurs with conventional image processing apparatus.
Figure 3B:
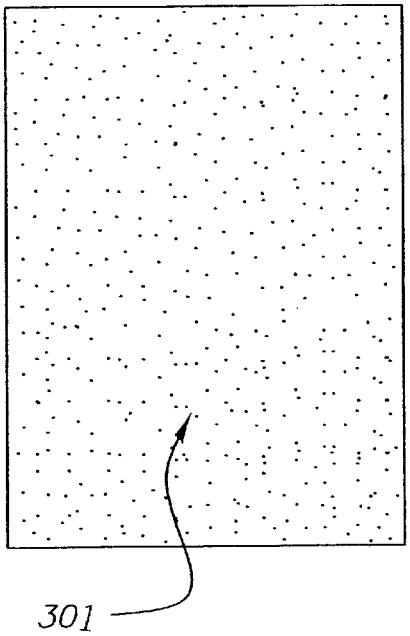

The efficacy of the charger ventilation system with respect to the prevention of the previously mentioned CRD defects is visually demonstrated in FIGS. 3A and 3B. More specifically, FIG. 3A is a schematic diagram of a uniform gray image reproduced by an image processing apparatus without the aid of the invention. The arrow 300 points to light areas that correspond to the CRD artifacts, as discussed above. To the contrary, as shown in FIG. 3B, such light areas are eliminated as shown by arrow 301. This shows the effectiveness of how the invention scavenges charger effluents from the charger body to prevent the formation of CRD artifacts.

Thus, the invention provides two basic modes of contamination control. First, the invention prevents effluents 205 created by the corona process from migrating into the rest of the EP engine and, secondly, the invention protects the corona charger 2 from being contaminated with effluents (primarily toner dust trapped in air flow stream 206) emitted from other subsystems in the EP engine. By using a non-contact, high-velocity, low-flow airflow positive air curtain 215, the inventive contamination control system does not impede the function of the corona charger.

While the invention has been described in terms of preferred embodiments, those skilled in the art will recognize that the invention can be practiced with modification within the spirit and scope of the appended claims.

Parts List

Item Description
1 primary image member
2 primary charging station
3 printhead
4 development station
5 intermediate transfer drum
6 conveyor
7 transfer backer roller
8 cleaning station
9 Pre-cleaning erase light emitting diode (led) lamp
10 pre-cleaning charging station
12 pre-cleaning charging station
15 imaging station
25 receiving sheet
30 fuser
35 output tray
201 push duct
202 pull duct
204 secondary opening
205 effluents
206 airflow stream
208 power supply wiring
210 drum surface
215 air current
300 CRD artifacts
301 no CRD artifacts

What is claimed is:

1. An image processing apparatus comprising:

a photoconductive surface adapted to receive an electrostatic charge from a charging device; and a contamination control apparatus adjacent said photoconductive surface and containing said charging device, for producing an air current that removes contaminants from an area near said charging device said contamination control apparatus having an input air push duct and an output air pull duct creating a positive air curtain that prevents air exterior to said contamination control apparatus from entering said contamination control apparatus, and said pull duct further drawing contaminants from said area of said photoconductive surface near said charging device.

2. The image processing apparatus in claim 1, wherein said positive air curtain deflects contaminants not removed by said pull duct to prevent said contaminants from entering said contamination control apparatus.

3. The image processing apparatus in claim 2, wherein during a charging of said photoconductive surface, ambient contaminants that are produced near said charging device are prevented from contaminating said photoconductive surface by said positive air curtain.

4. In an image processing apparatus including:

a photoconductive surface adapted to receive an electrostatic charge, and a corona charging device adjacent said photoconductive surface, for charging said photoconductive surface, said corona charging device comprising:

a contamination control apparatus adjacent said photoconductive surface and containing said charging device, for producing an air current that removes contaminants from an area near said charging device said contamination control apparatus having an input air push duct and an output air pull duct creating a positive air curtain that prevents air exterior to said contamination control apparatus from entering said contamination control apparatus, and said pull duct further drawing contaminants from said area of said photoconductive surface near said charging device.

5. The corona charging device in claim 4, wherein said input air push duct and said output airport pull duct define portions of sidewalls of said charging device.

6. A method of processing images comprising:

charging a photoconductive surface using a corona charging device;

establishing contamination control for the corona charging device by producing a positive air curtain between the corona charging device and the photoconductive surface, the positive air curtain preventing air exterior to the contamination control air curtain from entering the charging device, and further drawing contaminants away from adjacent to the photoconductive surface near the charging device;

modifying charge on said photoconductive surface relative to an image to be processed;

developing the modified charge with image marking particles; and transferring image marking particles to an image recording medium.

* * * * *